United States Patent [19]

Gemmeke et al.

[11] 4,065,296

[45] Dec. 27, 1977

[54] PROCESS FOR PREPARING COMPOSITION CONTAINING CARBON AND LOW SULFUR, NITROGEN AND ASH CONTENT

[75] Inventors: Wilfried Gemmeke, Essen; Heinrich Werner, Wattenscheid; Heinz Echterhoff, Essen; Erich Raulf, Castrop-Rauxel, all of Germany

[73] Assignee: Verkaufsgesellschaft fur Teererzeugnisse (VfT), Essen, Germany

[21] Appl. No.: 749,489

[22] Filed: Dec. 10, 1976

Related U.S. Application Data

[62] Division of Ser. No. 661,070, Feb. 25, 1976, Pat. No. 4,031,189.

[30] Foreign Application Priority Data

Mar. 13, 1975 Germany ..... 2510876

[51] Int. Cl.[2] ..... C21C 7/00

[52] U.S. Cl. ..... 75/48

[58] Field of Search ..... 75/48

[56] References Cited

U.S. PATENT DOCUMENTS 4,001,008 1/1977 Stift ..... 75/48

*Primary Examiner*—M. J. Andrews

*Attorney, Agent, or Firm*—Beveridge, DeGrandi, Kline & Lunsford

[57] ABSTRACT

Process for the preparation of a composition comprised mainly of carbon and containing only a small amount of ash, nitrogen and sulfur, said process comprising A. drying a hydrous soot with hot flue gas of about 600° C in a direct current-operated dryer to form a dried soot having a water content of about 5 to about 20 percent by weight;

B. carbonizing said dried soot in a vertical flue oven by heating at a flue temperature of about 900° to about 1300° C for about 25 to about 40 hours; and C. drying, comminuting and classifying the resulting composition.

The composition is useful as a coking agent, filter aid, and in the production of carbon and graphite products.

9 Claims, No Drawings

PROCESS FOR PREPARING COMPOSITION CONTAINING CARBON AND LOW SULFUR, NITROGEN AND ASH CONTENT

This is a division of application Ser. No. 661,070 filed Feb. 25, 1976 now U.S. Pat. No. 4,031,189.

BACKGROUND OF THE INVENTION

This invention relates to a process for preparing a composition high in carbon content and containing only a small amount of ash, nitrogen and sulfur by the conversion of a hydrous carbon sludge or carbon pellets.

It is known in the art that soot is obtained as a by-product from various chemical processes. For example, cracking of coal oil fractions and gases for the production of unsaturated hydrocarbons, as well as the pyrolysis of refuse, can result in the formation of soot. If this soot is obtained in "dry" form, then a useful product is obtained. Such a product has found application in the rubber and dye industries. When the processing technique yields a soot having such a high water content that it is obtained as a sludge or in a pasty consistency, for example, also pelletized, then the product is very difficult to handle, and is an undesirable by-product. In these cases, the water content can be as high as 40 to 70 weight percent. These wet soot products also contain hydrocarbons bound through adsorption. These hydrocarbons vary widely in composition, and result from the cracking reactions from which the soot product is derived. The storage and/or disposal of such soot products, therefore, can be a very serious problem, and can even pose serious difficulties relating to environmental protection.

There exists a need in the art for a method of converting hydrous carbon sludge or soot pellets into a product having a high carbon content with only slight admixtures of ash, nitrogen and sulfur.

SUMMARY OF THE INVENTION

Accordingly, this invention fulfills this need in the art.

It has now been found that it is possible to convert such a waste product into high-grade material of the following composition having a high content of carbon:

| | |
|---|---|
| Ash - free of water | 0.5 to 1% |
| Volatiles - Free of water and ash | 0.2 to 0.5% |
| Fixed carbon | 98.5 to 99.3% |

The percentages are by weight based on the weight of the carbon mixture. The by-products too are very favorable with nitrogen <0.3% sulfur <0.25% so that the material comminuted and classified in the proper form is very suitable as a carburizing agent in the iron and steel industry, especially for the production of high-grade steels. In this case, values below these border values of nitrogen and sulfur would be an advantage in the manufacture of iron and steel. In the production of synthetic carbon and graphite for the electrochemical, machine construction and chemical industries, such a product can also be used as a raw material, as well as a filter aid in the purification of water.

DETAILED DESCRIPTION

The task which was set was solved by a process which is characterized by the fact that the hydrous soot is dried down to 5 to 20% water content by weight in a DC electric current drier according to the construction Hazemag, or some comparable construction, with hot flue gases of about 600° C. Then, the soot pre-dried in this way is coked in a vertical flue oven without any further additions at a heating temperature of 900° to 1300° C and a coking time of 25 to 40 hours, and the coke thereby obtained is dried, comminuted and classified. In order to improve the coking capacity of the soot dried according to this invention, an additional 10 to 40% by weight, preferably 15 to 25% by weight of ground hard pitch from the tar of bituminous coal or petropitch or bitumen is admixed, or else an equivalent amount of soft pitch from the tar from bituminous coal. In one embodiment of this invention, about 10 to about 40% by weight of a soft pitch from bituminous coal is sprayed onto the dried soot to improve coking capacity. In another embodiment of this invention about 15 to about 25% by weight of a soft pitch from bituminous coal is sprayed onto the dried soot to improve coking capacity.

The biggest problem in the case of storing and transportation of a wet soot is the water content. Whenever a certain border value of the finished mixture which is to be used and which contains pitch or bitumen, of about 8 to 12% by weight of water, is exceeded, then the manipulation of this material, because of adhesion and agglutination, is so difficult, that for example, its introduction into a conventional coke oven becomes impossible. All attempts to improve the rheological behavior, for example, by the addition of oil or an admixture of coarser additives, were without success. Therefore, it was necessary to find ways and means of lowering the water content in the soot sludge to a value of 5 to 20%, preferably 10 to 15%.

Surprisingly, it has been found that the drying of this soot, despite its large surface and small particle size, in a thermal drier is possible whenever one operates in the continuous current principle with hot flue gases of about 600° C and whenever the transportation of the material in the drier is accomplished mechanically. This technique leads to very short tarry times, and it avoids overheating the material. As a result of that, a guarantee exists that the soot, despite its great fineness and despite the extremely large surface going hand in hand with this, does not ignite. The water content of the dried material can be controlled by the heat supply or by the throughput. Quite unexpectedly, dusting is very slight, probably as a result of the hydrocarbons left in the soot which lead to an agglomeration.

In the case of the process according to the invention, the emerging water vapors have a temperature of about 137° ± 20° C and the dried, solid material leaves the drier at about 73° ± 10° C, and as a result of that any ignition of the goods treated in this way will thereby be avoided. The hot heating gases should have as little oxygen as possible. By reflux cooling of the heating gas, lower boiling hydrocarbons can be recovered, and these hydrocarbons are valuable oil or chemical raw materials.

The dried soot produced in this way can be carbonized without any further additions whenever the residual hydrocarbons are sufficient as coke builders. In order to avoid any undesirable development of dust during the drying and in order to achieve a better carbonization behavior, it will be necessary to leave the higher boiling hydrocarbons in the soot. Insufficient coke building capacity can be compensated for by the addition of hard pitch, soft pitch or both from bituminous coal, and optionally through bitumen. The chemical composition of the product can be controlled within desired limits by the admixture of additives to the soot. As additives the following come into question:

1. Recycled material from one's own production (undersize);
2. Petroleum coke; and
3. Slag from the coke production, especially slag of tar pitch coke from bituminous coal.

The dried material or the mixtures of dried soot and additives produced from it resemble in their rheological behavior the standard coking coal mixtures. A carbonization in the standard vertical flue oven is thus possible without difficulty. The carbonization takes place at a width of the chamber of 450 mm and a heating flue temperature of 900° to 1300° C, preferably at 930° to 1000° C and a coking time of 25 to 40 hours, preferably 27 to 30 hours.

The coke obtained according to this invention is lumpy and solid, and can be converted by careful comminution, drying and classification into marketable products. It will be apparent that this process brings both technically as well as economically decisive advantages.

This invention will be more fully understood with reference to the following Example in which all parts, proportions, percentages and ratios are by weight unless otherwise indicated.

EXAMPLE

From 1000 parts of soot sludge with 41.2% of water, 600 parts of dried material with a water content of 8.5% are obtained in a direct current drier, design HAZEMAG, by means of a current of hot flue gases of about 600° C. During the drying, 40 parts of low boiling hydrocarbons are driven off, 360 parts of water are evaporated. Consequently, 600 parts of soot with 8.5% of water are available for further processing. The soot still contains higher boiling hydrocarbons.

For further processing 260 parts of ground hard pitch are admixed which contain 5.2% of water. A mixing ratio of 70:30 is employed. Since the 860 parts of original mixture employed have 7.5% water content, the anhydrous starting quantity is 796 parts. This mixture behaves rheologically similar to a standard coking coal.

The original mixture is carbonized in a vertical flue oven with a width of the chamber of 450 mm at a heating flue temperature of 950° C and a coking time of 27 hours. During the coking, 538.5 parts of coke, anhydrous; 213.0 parts of tar, anhydrous; 0.7 parts $(NH_4)_2SO_4$, anhydrous; 0.3 parts $H_2S$; 3.5 parts $C_6H_6$; and 40.0 parts of gas, anhydrous; are obtained. This results in a volume of gas of 158 m³. The gas consists of:

0.7% by vol.% $CO_2$
1.0% by vol.% Hydrocarbons
2.1% by vol.% CO
71.6% by vol.% $H_2$
19.2% by vol.% $CH_4$
5.4% by vol.% $N_2$ and it thus has a very similar composition to the standard cokeoven gas.

The coke obtained is lumpy and solid and is fed to the further processing. The coke is crushed and dried, and is converted as a result of classification into marketable products, especially a high-grade coking agent having little nitrogen and sulfur.

What is claimed is:

1. Process for carburizing iron or steel comprising adding to molten iron or steel a composition consisting essentially of carbon and containing only a small amount of ash, nitrogen and sulfur, said composition comprising a product obtained by:

A. drying a hydrous soot sludge of pasty consistency, said sludge having a water content of about 40 to about 70 percent by weight, with a hot flue gas having a temperature of about 600° C in a direct current operated dryer to form:
   1. a vapor stream having a temperature of about 137° ± 20° C; and
   2. a dried soot product having a water content of about 5 to about 20 percent by weight and a temperature of about 73° ± 10° C;

B. carbonizing said dried soot in a vertical flue oven by heating at a flue temperature of about 900° C to about 1300° C for about 25 to about 40 hours; and C. drying, comminuting and classifying the resulting composition.

2. Process as claimed in claim 1 in which said hydrous soot sludge is heated to form a dried soot having a water content of about 10 to about 15 percent by weight, and said dried soot is carbonized at a flue temperature of about 930° to about 1000° C for about 27 to about 30 hours.

3. Process as claimed in claim 1 in which said hydrous soot is derived from a hydrocarbon cracking reaction.

4. Process as claimed in claim 1 in which said hydrous soot is derived from pyrolysis of refuse.

5. Process for carburizing iron or steel comprising adding to molten iron or steel a composition consisting essentially of carbon and containing only a small amount of ash, nitrogen and sulfur, said composition comprising a product obtained by:

A. drying a hydrous soot paste having a water content of about 40 to about 70 percent by weight with a hot flue gas having a temperature of about 600° C in a direct current operated dryer to form:
   1. a vapor stream having a temperature of about 137° ± 20° C; and
   2. a dried soot product having a water content of about 5 to about 20 percent by weight and a temperature of about 73° ± 10° C;

B. mixing said dried soot with about 10% to about 40% by weight of ground, hard pitch from bituminous coal, soft pitch from bituminous coal, ground petroleum pitch or bitumen;

C. carbonizing said dried soot in a vertical flue oven by heating at a flue temperature of about 900° to about 1300° C for about 25 to about 40 hours; and D. drying, comminuting and classifying the resulting composition.

6. Process as claimed in claim 5 in which said hydrous soot is heated to form a dried soot having a water content of about 10 to about 15 percent by weight, and said dried soot is carbonized at a flue temperature of about 930° to about 1000° C for about 27 to about 30 hours.

7. Process as claimed in claim 5 in which said dried soot is mixed with about 15 to about 25% by weight of ground, hard pitch from bituminous coal, soft pitch from bituminous coal, ground petroleum pitch or bitumen in step (B).

8. Process as claimed in claim 5 in which said hydrous soot is derived from a hydrocarbon cracking reaction.

9. Process as claimed in claim 5 in which said hydrous soot is derived from pyrolysis of refuse.

* * * * *